US010794122B2

(12) United States Patent
Kitchen et al.

(10) Patent No.: US 10,794,122 B2
(45) Date of Patent: Oct. 6, 2020

(54) RELEASABLE CONNECTION FOR A DOWNHOLE TOOL STRING

(71) Applicant: Avalon Research Ltd., Grande Prairie (CA)

(72) Inventors: Derek Kitchen, Elmworth (CA); Jeffrey Golinowski, Sherwood Park (CA); Sylvain Hotte, Grande Prairie (CA); Trevor Rosten, Grande Prairie (CA)

(73) Assignee: Tier 1 Energy Tech Inc., Edmonton, Alberta (CA)

( * ) Notice: Subject to any disclaimer, the term of this patent is extended or adjusted under 35 U.S.C. 154(b) by 174 days.

(21) Appl. No.: 15/690,324

(22) Filed: Aug. 30, 2017

(65) Prior Publication Data

US 2018/0058154 A1 Mar. 1, 2018

Related U.S. Application Data

(60) Provisional application No. 62/381,083, filed on Aug. 30, 2016.

(51) Int. Cl.

| | |
|---|---|
| ***E21B 17/06*** | (2006.01) |
| ***E21B 17/02*** | (2006.01) |
| ***E21B 23/00*** | (2006.01) |

(52) U.S. Cl.

CPC ..... *E21B 17/06* (2013.01); *E21B 17/028* (2013.01); *E21B 23/00* (2013.01)

(58) Field of Classification Search

CPC ..... E21B 17/04; E21B 17/042; E21B 17/06; E21B 17/028; E21B 23/00

See application file for complete search history.

(56) References Cited

U.S. PATENT DOCUMENTS

| | | | | |
|---|---|---|---|---|
| 3,211,222 | A * | 10/1965 | Myers | E21B 31/1075 166/63 |
| 5,242,201 | A * | 9/1993 | Beeman | E21B 23/04 294/86.15 |
| 5,984,006 | A * | 11/1999 | Read | E21B 17/028 166/63 |
| 6,095,583 | A * | 8/2000 | Beeman | E21B 31/20 294/86.15 |
| 7,198,101 | B2 | 4/2007 | McGarian et al. | |
| 2013/0008669 | A1 * | 1/2013 | Deere | E21B 33/0385 166/378 |

* cited by examiner

*Primary Examiner* — David Carroll
(74) *Attorney, Agent, or Firm* — Bennett Jones LLP

(57) ABSTRACT

A releasable connection for a downhole tool string is provided, having a first part with a connection profile and a second part with a releasable engagement profile that releasably engages the connection profile of the first part. The second part also has a locking piston, the locking piston moving axially along the second part between a locking position that locks the releasable engagement profile into engagement with the connection profile of the first part and a release position that permits the releasable engagement profile to release the connection profile of the second part, an expansion chamber in fluid communication with the locking piston, and a source of fluid pressure in communication with the expansion chamber, wherein, upon activation, the source of fluid pressure applies fluid pressure to move locking piston from the locking position toward the release position.

19 Claims, 3 Drawing Sheets

RELEASABLE CONNECTION FOR A DOWNHOLE TOOL STRING

TECHNICAL FIELD

This relates to a releasable connection in a downhole tool string, such as a wireline or tubing string, and in particular, a connection that releases as a result of fluid pressure.

BACKGROUND

When conducting downhole operations, tools and other components are often inserted into wellbores using tool strings, such as wireline or tubing strings. If it is desired to leave a component downhole, or if a component or tool string becomes stuck downhole, it may be desirable to disconnect a releasable connection provided along the tool string. U.S. Pat. No. 7,198,101 (McGarian et al.) entitled "Downhole release joint" describes a tool that is released by applying torque to the releasable joint.

SUMMARY

According to an aspect, there is provided a releasable connection for a downhole tool string, comprising a first part comprising a connection profile and a second part comprising a releasable engagement profile that releasably engages the connection profile of the first part, a locking piston, the locking piston moving axially along the second part between a locking position that locks the releasable engagement profile into engagement with the connection profile of the first part and a release position that permits the releasable engagement profile to release the connection profile of the second part, an expansion chamber in fluid communication with the locking piston, and a source of fluid pressure in communication with the expansion chamber, wherein, upon activation, the source of fluid pressure applies fluid pressure to move locking piston from the locking position toward the release position.

According to another aspect, the releasable engagement profile may be spring biased away from the connection profile of the first part.

According to another aspect, the releasable engagement profile may be a collett having a plurality of fingers that engage the connection profile of the first part.

According to another aspect, the second part may comprise an outer housing, the locking piston being positioned within an internal cavity of the second part.

According to another aspect, the outer housing of the second part may comprise a pressure equalization ports, the locking piston closing the pressure equalization ports in the locking position, and opening the pressure equalization ports in the release position.

According to another aspect, the locking piston may comprise a piston section and a sleeve section that depends from the piston section, the sleeve section may overlie the releasable engagement profile, and the fluid pressure may be applied to the piston section.

According to another aspect, the releasable connection may further comprise a combustible disposed within the expansion chamber, wherein, upon combustion, the combustible may apply gas pressure to the locking piston.

According to another aspect, the expansion chamber may comprise a first volume that contains the combustible, and a second volume that encloses at least a portion of the locking piston, the first volume being in fluid communication with the second volume.

According to another aspect, the combustible may be detonated by an electrical signal.

According to another aspect, the first part may carry a first electrical connection, and the second part may carry a second electrical connection, the first and second electrical connection being electrically connected when the releasable engagement profile of the second part engages the connection profile of the first part, and becomes disconnected when the releasable engagement profile disengages the connection profile.

According to another aspect, the first electrical connection may be spring-mounted.

According to another aspect, the first electrical connection and the second electrical connection may be concentrically disposed within the connection profile and the releasable engagement profile.

According to another aspect, the first part may comprise a fishneck that attaches to a fishing tool when disconnected from the second part.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
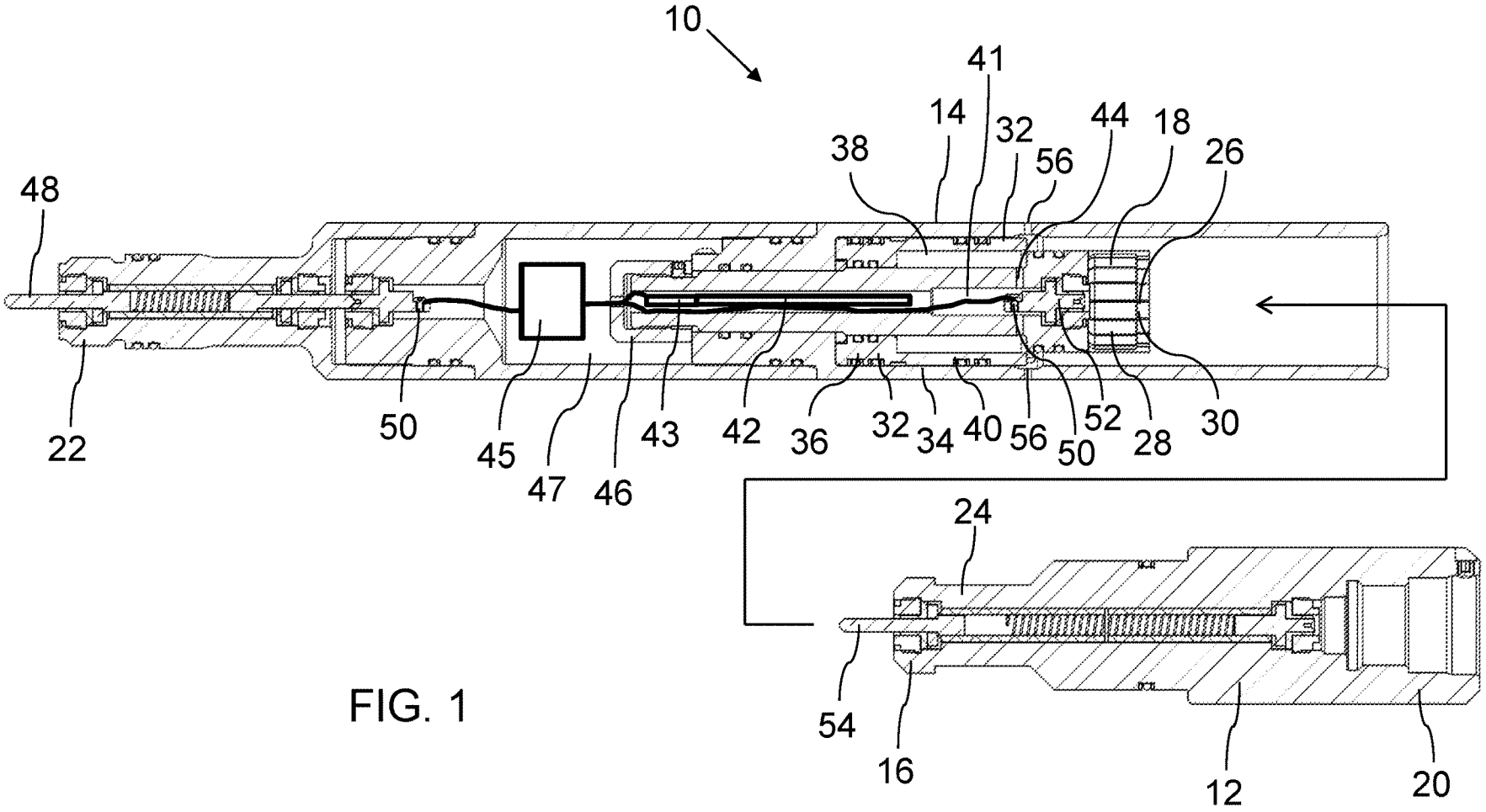
FIG. 1 is a side elevation view in section of the releasable connection in the release position.

A releasable connection, generally identified by reference numeral 10, will now be described with reference to FIG. 1 through 3.

Releasable connection 10 is designed for use in a downhole tool string (not shown), such as a wireline or tubing string. In one example, releasable connection 10 may be included in a downhole tool string for use in directional drilling. Releasable connection 10 may be positioned at any convenient location along the tool string, but will generally be located next to a tool section for convenience purposes. It has been found that, in some circumstances, such as in horizontal sections of a well, it may be difficult to apply the necessary force to disconnect a releasable connection in a tool string. The design of the presently described releasable connection is such that the release is triggered remotely without, or with a minimal amount, of force applied.

Referring to FIG. 1, releasable connection 10 has a first part 12 and a second part 14. First part 12 has a connection profile 16 at an upper end that connects with a releasable engagement profile 18 at a lower end of second part 14. First and second parts 12 and 14 also have tubing connectors 20 and 22 for connecting to a tool string (not shown) as is known in the art. It will be understood that, while releasable connection 10 is shown and described in a particular orientation, e.g. with first part 12 below or downstream of second part 14, the orientation and relative position of the various components may vary depending on the preferences of the user and particular design.

First part 12 is designed to be left downhole, and has a fishneck 24 that is part of, or below, connection profile 16. As shown, connection profile 16 is a lip that extends radially outward from fishneck 24, which also provides an engagement profile that can be engaged by a fishing tool. The actual design of fishneck 24 and connection profile 16 may be varied as is known in the art to be engaged or manipulated by the intended tool that will be lowered to first part 12 after second part 14 has been removed.

Second part 14 has a releasable engagement profile 26 that releasably engages connection profile 16 of first part 12. As shown, releasable engagement profile 26 is a collet with a series of resilient fingers 28 that extend axially in parallel with first part 12 and are spring-biased outward, such that when the piston moves, they move out of engagement with connection profile 16. Resilient fingers 28 have an inner profile 30 that engages connection profile 16, but is slightly tapered such that, when released, fingers 28 are pushed outward as first and second parts 12 and 14 move away from each other. Other designs may also be possible, including designs that do not include a resilient engagement. For example, rather than resilient fingers 28, releasable engagement profile 26 may be locking pins that move radially between a locking and release position.

Figure 2:
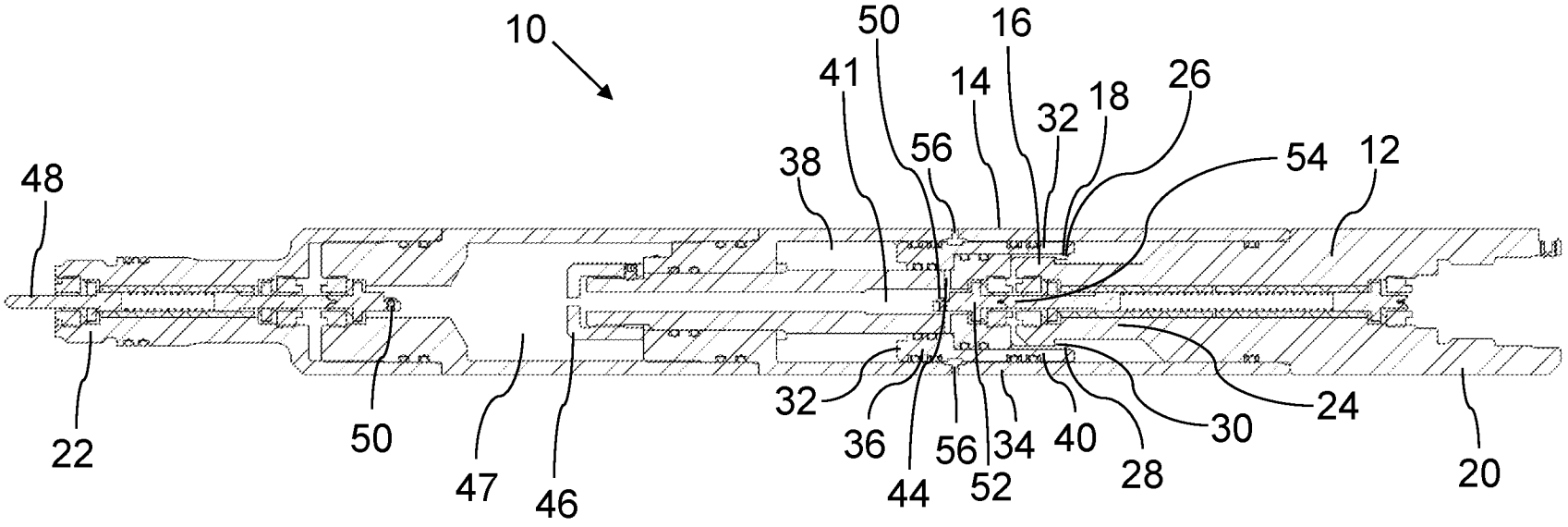
FIG. 2 is a side elevation view in section of the releasable connection in the engaged position.
Figure 3:
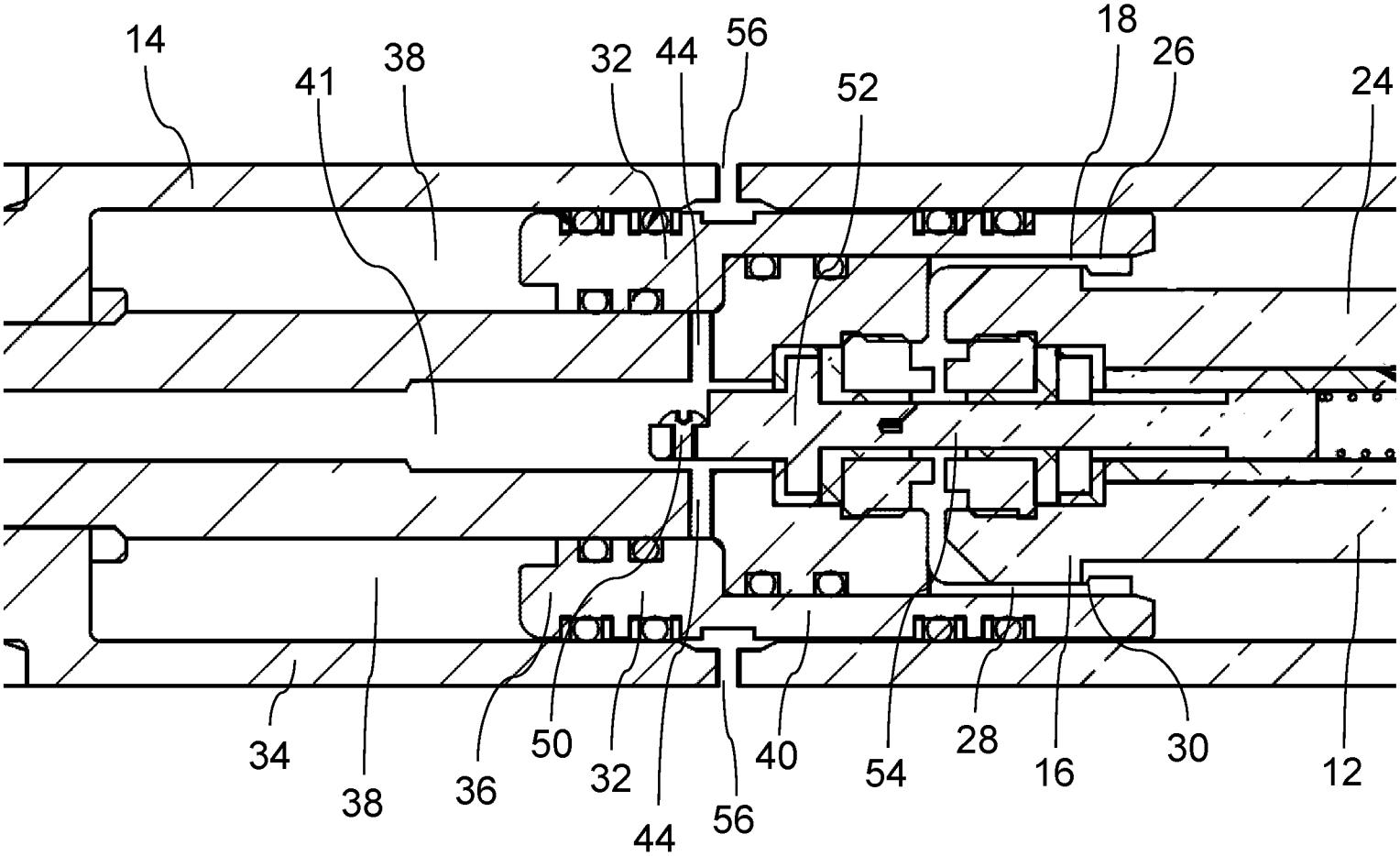
FIG. 3 is a detailed side elevation view in section of the releasable connection in the engaged position.

Releasable engagement profile 26 is locked in place by a locking piston 32, which moves axially along second part 14 between a locking position, shown in FIGS. 2 and 3, that locks releasable engagement profile 26 into engagement with connection profile 16 of the first part, and a release position, shown in FIG. 1, that permits releasable engagement profile 26 to release connection profile 16 of second part 14. It will be understood that various designs of locking piston 32 may be used to achieve this result. In the depicted example, locking piston 32 is positioned within the outer housing 34 of second part 14, with a piston section 36 located in an expansion chamber 38, which seals around piston section 36 while permitting axial movement, and a sleeve section 40 that depends from piston section 36. Sleeve section 40 overlies releasable engagement profile 26 in the locked position such that fingers 28 are unable to be pushed back from connection profile 16. In the release position, sleeve section 40 moves axially away from releasable engagement profile 26, which allows fingers 28 to move away from connection profile 16. While not shown, piston 32 is preferably held in place by a lock, such as a spring-biased engagement, or a shear screw, that is either released or sheared upon application of a sufficient actuating force in order to ensure that releasable connection 10 does not release prematurely.

Locking piston 32 is in fluid communication with an expansion chamber 38 to which fluid pressure is applied in order to apply a force that moves locking piston 32 toward the release position. Fluid pressure may include pressure applied by a liquid or a gas, which may be communicated to expansion chamber 38 in various ways. For example, there may be a gas cylinder that releases gas pressure upon activation, a fluid line that provides gas or liquid to expansion chamber 38 from surface, etc.

In the depicted example, there is a combustible 42 positioned within a combustion chamber 41. As shown, expansion chamber 38 and combustion chamber 41 are connected by ports 44, such that any gas pressure that results from the combustion of combustible 42 is applied to piston section 36 of locking piston 32, causing it to move from the locked position to the release position. It will be understood that expansion chamber 38 and combustion chamber 41 may be considered a single chamber, and may be designed as such. However, as piston 32 is actuated by gas pressure, resulting from combustion, some flexibility in the design is permitted, as long as the restrictions between chambers 38 and 41 are not sufficient to impede operation of connection 10.

Combustible 42 may be any suitable material that is able to be ignited remotely. Beneficial results were found when a slow burning combustible 42 was used, triggered by the same system used for a perforation gun used to perforate a casing string. Other combustibles 42 may be used, or other sources of fluid pressure as discussed above, depending on the preferences of the user and the specifications for a particular situation. In the depicted example, combustible 42 is triggered using a detonator 43, which is in turn controlled by a trigger 45 wired to the electrical system and located in a trigger cavity 47. The detonator 43 is enclosed within combustion chamber 41 by a detonator cap 46, which closes an upper end of combustion chamber 41. The trigger 45 may have a microprocessor or other programmable circuit that is activated only upon receiving a predetermined electrical signal or code to prevent accidentally triggering the combustible 42 prematurely. The electrical system is connected through an upper electrode 48 in second part 14, and through a wire (not shown) that is connected between connection points 50 spaced throughout second part 14. The electrical system is then passed from second part 14 to first part 12 by way of lower electrodes 52 in second part 14, and a spring-mounted upper electrode 54 in first part 12. Upon ignition and separation, the electrical connection will be broken by first and second parts 12 and 14 separating, and also damage that may occur to any wire passing by the detonator 43 or combustible 42 when ignited. When assembling first and second parts 12 and 14, the electrical connection is made by the concentrically-located electrodes 52 and 54 to allow an electrical signal to pass through releasable connection 10 to the tools below releasable connection 10. It will be understood that, depending on the operation being conducted, an electrical connection may not be required. Furthermore, combustible 42 may be triggered in other ways, such as by applying a predetermined hydraulic or mechanical force to the downhole tool, as will be apparent to those skilled in the art.

When combustible 42 is ignited, the combustion process will generate gas pressure, causing an increase in gas pressure within expansion chamber 38 and pushing piston 32 away from the locking position adjacent to releasable engagement profile 26 toward the release position. Once in the release position, piston 32 also opens pressure equalization ports 56, which allows the combustion gas pressure to be released, but also allow the pressure within inner cavity of second part 14 to be equalized with the wellbore pressure. If first part 12 is sealably received within second part 14, as would be the case in the depicted example, a lower pressure within second part 14 relative to the wellbore would result in a vacuum that would resist the release of first part 12. Pressure equalization ports 56 help reduce this possibility. Alternatively, it may be that the combustion of combustible 42 may generate sufficient force to both move piston 32 and also push apart first and second parts 14. As this will be dependent on the wellbore pressure, it may be preferable to ensure the pressure is equalized using equalization ports 56 instead.

Once piston 32 has been shifted sufficiently, second part 14 may be disengaged from first part 12 by pulling applying a sufficient force to second part 14 to disengage releasable engagement profile 26 from connection profile 16. While releasable engagement profile 26 may be resilient and resist outward movement, releasable engagement profile 26 may also be simple engagement members that are able to slide out of the way once piston 32 has been shifted.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A releasable connection for a downhole tool string, comprising a first part comprising an external connection profile; and a second part comprising:

an outer housing;

a releasable engagement profile which internally engages the connection profile of the first part and which is configured to expand radially to release the connection profile of the first part;

a locking piston positioned within an internal cavity of the second part, the locking piston configured to move axially along the second part between a locking position that directly constrains the releasable engagement profile into engagement with the connection profile of the first part and a release position that permits the releasable engagement profile to expand radially to release the connection profile of the second part;

an expansion chamber in fluid communication with the locking piston; and a source of fluid pressure in communication with the expansion chamber, wherein, upon activation, the source of fluid pressure is configured to apply fluid pressure to move the locking piston from the locking position toward the release position.

2. The releasable connection of claim 1, wherein the releasable engagement profile is spring biased away from the connection profile of the first part.

3. The releasable connection of claim 1, wherein the releasable engagement profile is a collett having a plurality of fingers that engage the connection profile of the first part.

4. The releasable connection of claim 1, wherein the outer housing of the second part comprises a pressure equalization ports, the locking piston configured to close the pressure equalization ports in the locking position, and open the pressure equalization ports in the release position.

5. The releasable connection of claim 1, wherein the locking piston comprises a piston section and a sleeve section that depends from the piston section, the sleeve section overlying the releasable engagement profile, and the fluid pressure is applied to the piston section.

6. The releasable connection of claim 1, wherein the first part comprises a fishneck that attaches to a fishing tool when disconnected from the second part.

7. A releasable connection for a downhole tool string, comprising:

a first part comprising an external connection profile; and a second part comprising:

a releasable engagement profile which internally engages the connection profile of the first part and which is configured to expand radially to release the connection profile of the first part;

a locking piston, the locking piston configured to move axially along the second part between a locking position that directly constrains the releasable engagement profile into engagement with the connection profile of the first part and a release position that permits the releasable engagement profile to expand radially to release the connection profile of the second part;

an expansion chamber in fluid communication with the locking piston;

a combustible disposed within the expansion chamber, wherein, upon combustion, the combustible applies gas pressure to the locking piston to move the locking piston from the locking position toward the release position.

8. The releasable connection of claim 7, wherein the expansion chamber comprises a first volume that contains the combustible, and a second volume that encloses at least a portion of the locking piston, the first volume being in fluid communication with the second volume.

9. The releasable connection of claim 7, wherein the combustible is configured to be detonated by an electrical signal.

10. The releasable connection of claim 7 wherein the second part comprises an outer housing and the locking piston is positioned within an internal cavity of the second part.

11. The releasable connection of claim 7, wherein the locking piston comprises a piston section and a sleeve section that depends from the piston section, the sleeve section overlying the releasable engagement profile, and the fluid pressure is applied to the piston section.

12. The releasable connection of claim 7, wherein the first part carries a first electrical connection, and the second part carries a second electrical connection, the first and second electrical connection being electrically connected when the releasable engagement profile of the second part engages the connection profile of the first part, and becomes disconnected when the releasable engagement profile disengages the connection profile.

13. A releasable connection for a downhole tool string, comprising:

a first part comprising an external connection profile; and a second part comprising:

a releasable engagement profile which internally engages the connection profile of the first part and which is configured to expand radially to release the connection profile of the first part;

a locking piston, the locking piston configured to move axially along the second part between a locking position that directly constrains the releasable engagement profile into engagement with the connection profile of the first part and a release position that permits the releasable engagement profile to expand radially to release the connection profile of the second part;

an expansion chamber in fluid communication with the locking piston; and a source of fluid pressure in communication with the expansion chamber, wherein, upon activation, the source of fluid pressure is configured to apply fluid pressure to move the locking piston from the locking position toward the release position, wherein the first part carries a first electrical connection, and the second part carries a second electrical connection, the first and second electrical connection being electrically connected when the releasable engagement profile of the second part engages the connection profile of the first part, and becomes disconnected when the releasable engagement profile disengages the connection profile.

14. The releasable connection of claim 13, wherein the first electrical connection is spring-mounted.

15. The releasable connection of claim 13, wherein the first electrical connection and the second electrical connection are concentrically disposed within the connection profile and the releasable engagement profile.

16. The releasable connection of claim 10, wherein the outer housing of the second part comprises a pressure equalization ports, the locking piston configured to close the pressure equalization ports in the locking position, and open the pressure equalization ports in the release position.

17. The releasable connection of claim 13, wherein the locking piston comprises a piston section and a sleeve section that depends from the piston section, the sleeve section overlying the releasable engagement profile, and the fluid pressure is applied to the piston section.

18. The releasable connection of claim 13 wherein the second part comprises an outer housing and the locking piston is positioned within an internal cavity of the second part.

19. The releasable connection of claim 18, wherein the outer housing of the second part comprises a pressure equalization ports, the locking piston configured to close the pressure equalization ports in the locking position, and open the pressure equalization ports in the release position.

* * * * *